US009017531B2

(12) United States Patent
Huhn et al.

(10) Patent No.: US 9,017,531 B2
(45) Date of Patent: Apr. 28, 2015

(54) TOOL FOR GALVANICALLY COATING SLIDING BEARINGS

(75) Inventors: Hans-Ulrich Huhn, Schlangenbad (DE); Axel Rothe, Hohenstein (DE)

(73) Assignee: Federal-Mogul Wiesbaden GmbH, Wiesbaden (DE)

( * ) Notice: Subject to any disclaimer, the term of this patent is extended or adjusted under 35 U.S.C. 154(b) by 340 days.

(21) Appl. No.: 13/522,096

(22) PCT Filed: Jan. 12, 2011

(86) PCT No.: PCT/EP2011/050327

§ 371 (c)(1), (2), (4) Date: Oct. 15, 2012

(87) PCT Pub. No.: WO2011/086089

PCT Pub. Date: Jul. 21, 2011

(65) Prior Publication Data

US 2013/0032475 A1 Feb. 7, 2013

(30) Foreign Application Priority Data

Jan. 13, 2010 (DE) ..... 10 2001 000 853

(51) Int. Cl.

| | |
|---|---|
| ***C25D 17/00*** | (2006.01) |
| ***C25D 5/02*** | (2006.01) |
| ***C25D 7/10*** | (2006.01) |
| ***C25D 17/06*** | (2006.01) |
| ***C25D 17/10*** | (2006.01) |

(52) U.S. Cl.

CPC ..... *C25D 17/007* (2013.01); *C25D 5/02* (2013.01); *C25D 7/10* (2013.01); *C25D 17/06* (2013.01); *C25D 17/10* (2013.01)

(58) Field of Classification Search

CPC ..... C25D 17/06; C25D 17/08; C25D 7/10; C25D 7/04; B05C 13/02; B05C 13/025

USPC ..... 204/297.01, 298.15, 297.05, 297.06; 205/122; 269/287, 53

See application file for complete search history.

(56) References Cited

U.S. PATENT DOCUMENTS

| | | | | |
|---|---|---|---|---|
| 2,500,206 | A | 3/1950 | Schaefer et al. | |
| 2,727,858 | A | 12/1955 | Klein | |
| 7,442,285 | B2 * | 10/2008 | Brondum | 205/192 |
| 2008/0179180 | A1 | 7/2008 | McHugh et al. | |
| 2008/0277286 | A1 * | 11/2008 | Richardson et al. | 205/147 |

FOREIGN PATENT DOCUMENTS

| | | | | |
|---|---|---|---|---|
| GB | 1239222 | A * | 5/1967 | 205/147 |
| GB | 1 239 222 | A | 7/1971 | |
| GB | 1 288 980 | A | 9/1972 | |
| JP | 57158395 | A | 9/1982 | |
| JP | 03170696 | A | 7/1991 | |
| JP | 03267394 | A | 11/1991 | |

* cited by examiner

*Primary Examiner* — Luan Van
*Assistant Examiner* — Alexander W Keeling
(74) *Attorney, Agent, or Firm* — Robert L. Stearns; Dickinson Wright, PLLC

(57) ABSTRACT

The invention relates to a tool for galvanically coating sliding bearings comprising at least one cover, to which a thief is attached.

12 Claims, 3 Drawing Sheets

TOOL FOR GALVANICALLY COATING SLIDING BEARINGS

BACKGROUND OF THE INVENTION

1. Technical Field

The invention relates to a tool for galvanically coating sliding bearings.

2. Related Art

The typical construction of a sliding bearing from the group of materials of the sliding bearings to be galvanically coated consists of a steel backing with a lead-containing or lead-free layer composite. The galvanic sliding layer applied to the running surface of the sliding bearing is a multifunctional material and performs various functions. Coating takes place in a box-shaped tool, which is also referred to as a receiver. In the coating, it is further to be ensured that the faces at which the bearing shells are divided (dividing face) are preferably not coated. Furthermore, a coating is not desired for the bearing backing, that is to say the cylindrical outer surface of the bearing shells. For that purpose, there are provided in the region of the bearing backing so-called thief cathodes or elements, which are suitably connected in such a manner that the bearing backing remains largely free of a coating.

Hitherto, one or more "towers" or columns of bearing shells have been erected one above the other in such a manner that the axial directions of the individual bearing shells coincide. The bearing shells are braced in this axial direction by means of a spring pressure. However, this structure is comparatively unstable, so that the columns of bearing shells frequently cave in, are highly coated on the dividing faces, and a considerable proportion of rejects is obtained. At the beginning and end of the column, so-called dummy shells of steel are used. The dummy shell at the beginning of the column of bearing shells to be coated covers the transition region between the air and the electrolyte. The lower dummy shell serves to stabilise the column and to maintain the tolerances of the deposited layer within the column of bearing shells. The above-mentioned thief cathode is fixed in the tool.

SUMMARY OF THE INVENTION

The object underlying the invention is to provide a tool by means of which sliding bearing shells can be galvanically coated in an efficient manner.

Consequently, the tool according to the invention has at least one cover, to which a thief cathode is attached. In other words, the thief cathode is integrated into the cover, which leads to the particular advantages that the thief cathode can be removed during the process. This is different from the cathodes used hitherto, which are fixed in the tool. The possibility of removing the thief cathode during the coating process offers the following advantage. After the "main" coating, the running surface is conventionally provided with a binary or ternary lead-free sliding layer. The steel backing must subsequently be provided with a so-called flash. This flash, which is based, for example, on tin, serves as corrosion protection and is to be applied primarily to the steel bearing backing in order to protect the highly reactive steel from oxidation in the air (rust). This corrosion protection is accordingly to be applied primarily to the bearing backing. However, that region is not coated in the presence of the thief cathode. Consequently, while the current, in the context of the main coating, is passed over a resistor of, for example, from 0.001 ohm to 0.02 ohm, in particular from 0.003 ohm to 0.0095 ohm, before being passed to the bearing shells to be coated, in order to produce a potential difference between the thief cathode and the bearing shells, in order to prevent coating on the backing, that potential difference is eliminated by the removal of the thief cathode and the bearing backings can advantageously be provided with the desired corrosion protection.

Preferably, the tool according to the invention further has at least one holder, which is characterised in that it has at least one bar suitable for mechanically fixing and/or electrically contacting a plurality of bearing shells. By means of the mechanical fixing, optionally in conjunction with a section, for example a wall of the tool, the column of bearing shells is prevented from caving in. The holder presses the column of bearing shells against a wall of the tool, for example, by means of the at least one bar, so that there is a substantially lower risk of the column of bearing shells caving in, collapsing of the column of bearing shells is eliminated, and coating of the dividing face is avoided. The proportion of rejects is markedly reduced as a result. In particular, it has been possible to establish in initial tests that the rejects resulting from collapsed bearing shells can be reduced to zero. Furthermore, undesirable coating of the dividing faces can be prevented by the pressing against the tool wall.

By the contacting of a plurality of bearing shells on their respective backings, a plurality, preferably all, of the bearing shells to be coated are contacted by the holder according to the invention. The resistance within the column of bearing shells is thereby reduced, and the sliding surface of the bearing shell can be coated with a markedly reduced variation in the coating thickness. In particular, it has been found that the variation within a column of bearing shells with the holder according to the invention is only approximately from 2 μm to 3 μm and coating of the dividing face is avoided, while in the procedure used hitherto, in which only the end faces of the column of bearing shells were contacted, a variation of from 6 μm to 7 μm occurred and the dividing face was coated with up to 20 μm. Accordingly, it was possible to reduce markedly the rejects due to significant variation. On account of its function, the described holder can also be referred to as backing contacting. This constitutes an independent aspect of the present application, which develops its advantages independently of the features described hereinabove or hereinbelow but can be combined therewith.

In particular for stability with regard to the mechanical fixing, a plurality, in particular an even number, of largely parallel bars has been found to be advantageous. Together with the pressing against a wall of the tool, it is possible, for example, with two parallel bars to create a statically determinate fixing. Furthermore, it is advantageous for the efficiency of the coating of a plurality of in particular comparatively small bearing shells for two or more bearing shell columns to be erected side by side, which means an even number of largely parallel bars for a mechanically advantageous fixing. It will be appreciated that it is possible for only two or three such bars to be present in order to electrically contact and mechanically fix a single column of bearing shells. This can be provided, for example, in the case of comparatively large bearing shells. Furthermore, it is conceivable in principle to provide such a holder for more than two columns of bearing shells. A holder for two columns of bearing shells has been found to be successful, for example, for bearing shells having a diameter of from 28 mm to 70 mm, while for larger bearing shells a holder for a single bearing shell can be provided.

The specific requirements that are made of the respective components can be satisfied particularly successfully if the holder, as preferred, itself is made of plastics material and the contact bars or rails are made of metal.

For the performance of the tasks required of the holder, it is advantageous if the holder can be fixed and preferably braced in the tool. In particular, bracing can be carried out in such a manner that the bearing backings are particularly well contacted and/or the dividing faces of the bearing shells are pressed particularly firmly against a wall of the tool, so that coating here is advantageously prevented.

The tool according to the invention preferably further has at least one plastics block, which is arranged above the columns of bearing shells in order to ensure, in particular at the upper end of the column of bearing shells, that all the bearing shells are located beneath the surface of the electrolyte bath and are reliably coated. The dummy shell at the bottom is not necessary, which results in an increase in productivity.

BRIEF DESCRIPTION OF THE DRAWINGS

An exemplary embodiment shown in the drawings is explained in detail below. In the drawings.

DETAILED DESCRIPTION OF AN EXEMPLARY EMBODIMENT OF THE INVENTION

Figure 1:
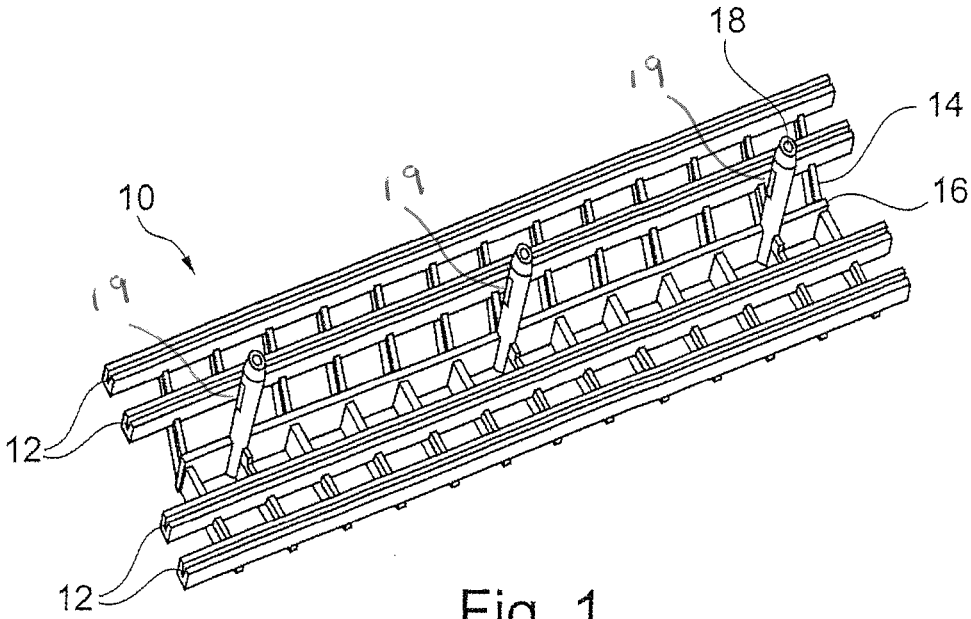
FIG. 1 shows a perspective view of a holder.

The holder 10 shown in FIG. 1, which can also be referred to as backing contacting, has in the embodiment shown four largely parallel rails or bars 12, which are made of metal, for contacting, in each case in pairs, bearing shells (not shown). In the embodiment shown, the metal bars are embedded in slightly wider plastics bars, which are connected to one another and to a central plastics bar 16 by a number of cross-members 14. Overall, in the embodiment shown, the holder 10, with the exception of the metal rails 12, is made of plastics material. This is true in particular also for the pins 18, which in the embodiment shown are present in triplicate and in the embodiment shown each have a radial through-slot 19 which extends approximately in the direction of the bars 12, 16.

The holder shown is used in such a manner that the bearing shells that are to be coated are erected thereon in a column. In the embodiment shown, two columns are erected in parallel and are each contacted by the two metal bars 12 located on one side or the other of the central bar 16. This contacting takes place, including a mechanical fixing to the tool, particularly reliably and securely when the three pins 18 have been inserted through a wall of the tool and bars or pegs, which are preferably wedge-shaped, have been introduced into the described slots in the pins and braced, so that the holder 10 is pressed against the tool wall so that the bearing shells arranged therebetween are both fixed mechanically and contacted electrically by the metal bars 12.

Figure 2:
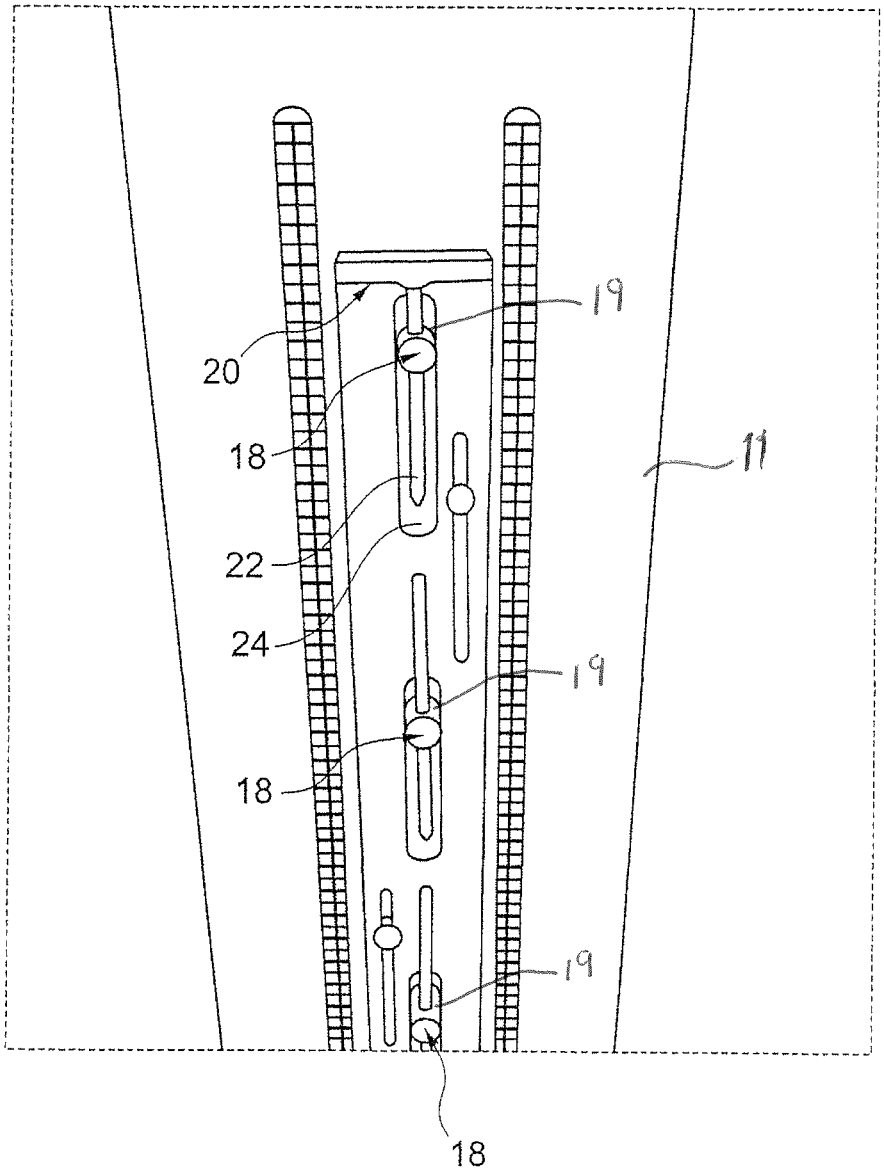
FIG. 2 shows a rear view of a tool according to the invention showing the bracing of the associated holder.

This bracing of the holder 10 in a tool 11 is shown in FIG. 2. The wedges 22 to be introduced into the slots in the pins 18 can be provided on a plate 20, which has an opening 24 surrounding each of the wedges on three sides. As a result, the plate can be braced, for example, by introducing the pins 18 into the opening 24 beneath each wedge 22 and then sliding the plate 20 so that each of the wedges 22 enters the respective slot. The plate 20 thereby moves with respect to the pins, downwards in the embodiment shown in FIG. 2, the pins being received in the regions of the openings 24 arranged at the side of the wedges 22.

Figure 3:
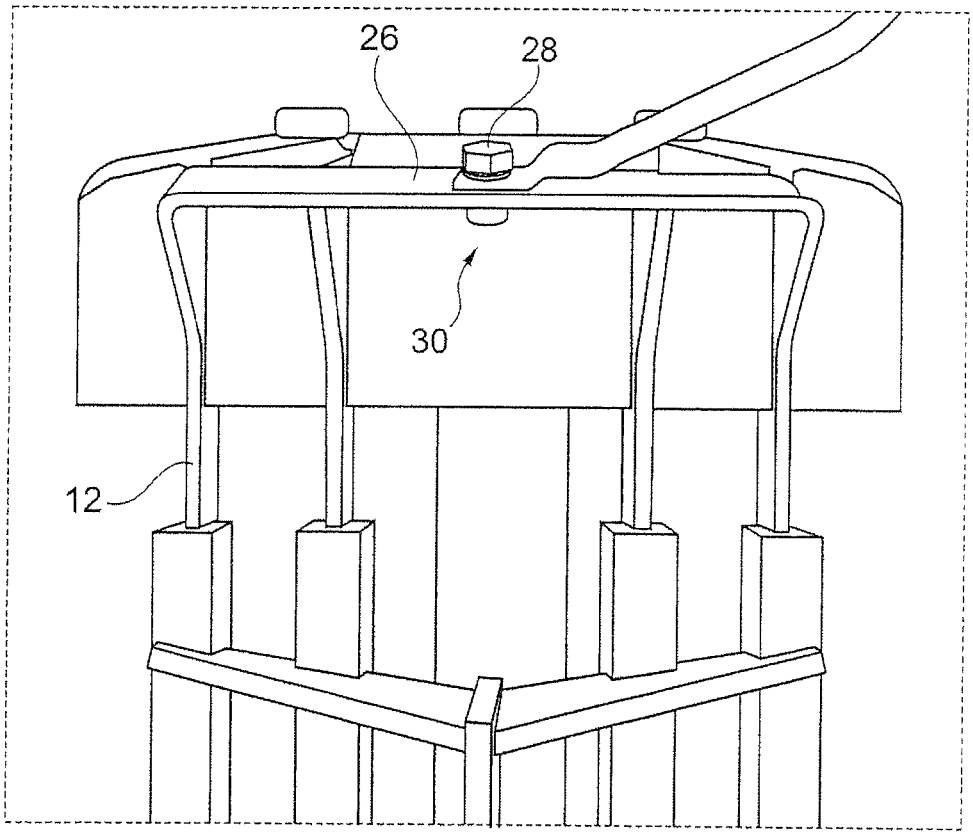
FIG. 3 shows a portion of the holder shown in FIG. 1 with further elements of a tool.

In FIG. 3 it is shown that the metal rails 12 are brought together in a particular upper region by a cross-connection 26 and connected to a power connector 28. In this region, the metal rails 12 are no longer embedded in the plastics material of the receiver 10. There is further shown in FIG. 3 a plastics block 30, which on the one hand has openings for the upper end regions of the rails 12 and on the other hand serves to axially brace the erected bearing shells 32. Furthermore, the distance to the air above the electrolyte bath is adjusted by the plastics block 30, so that in other words it is ensured that all the bearing shells are reliably located beneath the surface of the electrolyte bath.

Figure 4:
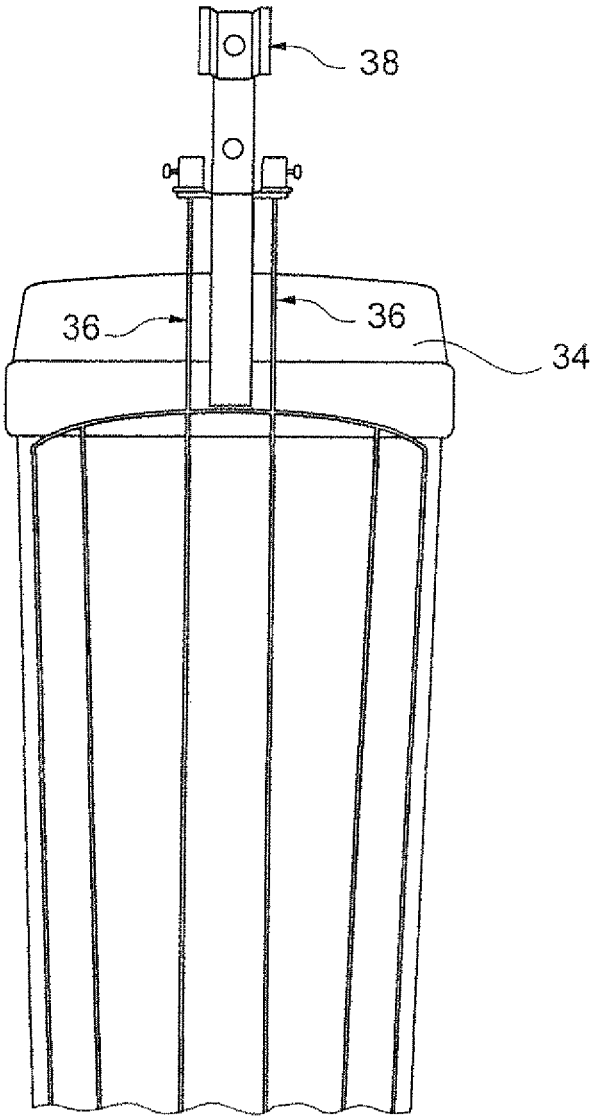
FIG. 4 shows a tool lid.

Finally, FIG. 4 shows a tool cover 34 in which the so-called thief cathode 36 is advantageously integrated. In the embodiment shown, the thief cathode 36 is composed of several mutually connected rods which are arranged in the region of the bearing backings (which face the viewer in FIG. 3) in order to produce a potential difference with respect to the bearing backing, which ensures that the backings are not coated. In the upper region of the cover 34 there is provided a power connector 38 for the thief cathode 36, in order to produce the described potential difference.

The invention claimed is:

1. A tool for galvanically coating sliding bearings, having at least one cover, to which a thief cathode is attached, and at least one holder for supporting a plurality of bearing shells that are to be arranged in a pillar-shaped manner and to be galvanically coated, said holder having an even number of parallel bars which are suitable for mechanically fixing and/or electrically contacting the plurality of bearing shells, and said holder including pins which can be inserted through a wall of the tool, said pins having slots into which bars or pegs can be inserted and braced in such a manner that the holder is pressed toward a tool wall which would cause the bearing shells arranged between the holder and the tool wall to be firmly pressed and held between the holder and the tool wall.

2. The tool according to claim 1, wherein the holder is made of plastics material and at least one bar is made of metal.

3. The tool according to claim 1, wherein the holder is attached in the tool.

4. The tool according to claim 1, including at least one plastics block.

5. The tool according to claim 1, wherein the holder is braced in the tool.

6. A tool for fixturing sliding bearings for a galvanic coating operation, said tool comprising:

a holder having at least two metal support rails arranged in side-by-side manner for cradling a plurality of bearing shells arranged one after the other in pillar-shaped manner, said holder including a plurality of pins and wherein at least one of said pins includes a slot;

at least one bar having openings arranged and sized to receive said pins; and at least one wedge slideable in said slot of said at least one pin and said at least one wedge operative to urge said bar toward said holder to effect a clamping pressure on the bearing shells when cradled in said rails.

7. The tool of claim 6, including a plate on which said at least one said wedge is integrally mounted.

8. The tool according to claim 7, wherein said plurality of pins each include a said slot.

9. The tool according to claim 8, wherein said plate includes a plurality of said wedges that are slideable into said plurality of said slots of said pins.

10. The tool according to claim 9 including a tool wall positioned between said holder and said bar and through which said slotted pins project for coupling with said bar.

11. The tool of claim 10 including a cover and a thief cathode attached to said cover.

12. The tool according to claim 6 including a plastics block attached to an end of said rails.

* * * * *